US012760989B2

(12) United States Patent
Moretti

(10) Patent No.: US 12,760,989 B2
(45) Date of Patent: Oct. 13, 2026

(54) PORTABLE WEAPON ASSEMBLY

(71) Applicant: BENELLI ARMI S.P.A., Urbino (IT)

(72) Inventor: Luigi Moretti, Collebeato (IT)

(73) Assignee: BENELLI ARMI S.P.A., Urbino (IT)

( * ) Notice: Subject to any disclaimer, the term of this patent is extended or adjusted under 35 U.S.C. 154(b) by 30 days.

(21) Appl. No.: 18/796,696

(22) Filed: Aug. 7, 2024

(65) Prior Publication Data

US 2025/0052536 A1 Feb. 13, 2025

(30) Foreign Application Priority Data

Aug. 10, 2023 (IT) ..... 102023000017088

(51) Int. Cl.
*F41C 23/18* (2006.01)
*F41C 23/08* (2006.01)
*F41C 23/16* (2006.01)

(52) U.S. Cl.
CPC ..... *F41C 23/18* (2013.01); *F41C 23/08* (2013.01); *F41C 23/16* (2013.01)

(58) Field of Classification Search
CPC ..... F41C 23/08; F41C 23/14; F41C 23/16; F41C 23/18; F41C 23/20; F41C 23/22; F41A 3/66
See application file for complete search history.

(56) References Cited

U.S. PATENT DOCUMENTS 4,674,216 A * 6/1987 Ruger ..... F41C 23/18 42/71.01
5,737,865 A 4/1998 Brandl et al.
6,070,354 A * 6/2000 Burigana ..... F41C 23/18 42/71.01
6,256,921 B1 * 7/2001 Howard ..... F41C 23/18 42/71.01
6,301,817 B1 * 10/2001 Hogue ..... F41C 23/18 42/71.01
6,427,372 B1 8/2002 Howard
8,387,297 B2 3/2013 Debrun et al.
9,389,033 B1 7/2016 Underwood
11,841,208 B1 * 12/2023 Roth ..... F41C 23/14
2005/0235545 A1 * 10/2005 Roller ..... F41A 21/485 42/75.1
2012/0144715 A1 * 6/2012 Simpson ..... F41C 23/18 42/74
2014/0224114 A1 * 8/2014 Faxon ..... F41A 5/28 89/193
2017/0241738 A1 * 8/2017 Simpson ..... F41C 23/06
2018/0356183 A1 * 12/2018 Romer ..... F41C 23/08
2019/0049203 A1 2/2019 Song
2019/0316873 A1 * 10/2019 Kronengold ..... F41C 23/08
2019/0390936 A1 * 12/2019 Keng ..... F41C 23/22
2020/0191521 A1 6/2020 Jones et al.
2020/0232734 A1 * 7/2020 Herring ..... F41A 9/37
(Continued)

FOREIGN PATENT DOCUMENTS

CZ 283030 2/1996
SU 204182 1/1980
WO 2017109268 6/2017

*Primary Examiner* — Joshua E Freeman

(74) *Attorney, Agent, or Firm* — DUANE MORRIS LLP; Gregory M. Lefkowitz; Daniel J. Tarr

(57) ABSTRACT

A portable weapon assembly comprising a receiver made in a single polymer body without any inner metallic structural element; said assembly having an inner cavity.

19 Claims, 14 Drawing Sheets

(56) References Cited

U.S. PATENT DOCUMENTS

| | | | | |
|---|---|---|---|---|
| 2020/0386510 | A1* | 12/2020 | Moretti | F41C 23/14 |
| 2022/0099406 | A1* | 3/2022 | Baumbach | F41C 23/18 |
| 2022/0136788 | A1 | 5/2022 | Caudle | |
| 2024/0263913 | A1* | 8/2024 | Merelli | B29C 70/44 |
| 2024/0418478 | A1* | 12/2024 | Muska | F41C 23/16 |

* cited by examiner

PORTABLE WEAPON ASSEMBLY

The present invention relates to a portable weapon assembly.

More particularly, the invention relates to a portable weapon such as a long gun or longarm, and more particularly to a smoothbore gun, such as a shotgun.

Shotguns generally comprise a frame, commonly called a receiver, made of steel or light alloy, e.g. Ergal.

The materials used to make the receiver of traditional weapons provide excellent performance from a technical point of view, but also have the disadvantage of high cost.

In addition, a conventionally manufactured receiver has a high production cost due to the relatively large number of processes required to obtain it.

Traditional weapons, such as shotguns, have a stock generally made of wood or possibly plastic or metal, e.g. of the folding type.

The main drawback of such conventional construction is the need to assemble the various parts that make the stock and to assemble the stock to the weapon.

Several alternative gun structures are known in the art.

DE19512178 discloses a repeating shotgun, in particular an automatic shotgun, having a barrel rigidly attached to a plastic housing with a metal fastener.

U.S. Pat. No. 5,513,461 discloses a lightweight automatic rifle having a hollow plastic housing with a metal sleeve.

U.S. Pat. No. 4,674,216 discloses a plastic rifle stock with panel inserts.

U.S. Pat. No. 6,301,817B1 discloses a long gun stock comprising a rigid insert molded of reinforced thermoplastic material together with a foaming agent. The insert is over-molded with a thermoplastic material which provides the stock with the desired surface characteristics. The insert is dimensioned with respect to its over-molded surfaces to be smaller than the finished stock and is designed to give strength to the stock. The insert is shaped to promote the flow of the over-mold material and to minimize shrinking, swelling or distortion of the insert.

US2020/191521A1 discloses a firearm stock having a fore-end portion and a pistol grip portion. The fore-end portion has a fore-end portion cavity and a fore-end insert. The fore-end insert has a fore-end insert reinforcing structure disposed in the fore-end portion cavity. The pistol grip portion has a pistol grip portion cavity and a pistol grip insert. The pistol grip insert has a pistol grip insert reinforcing structure disposed in the pistol grip portion cavity.

US2018/356183A1 discloses a butt plate for a gun stock having a holding part and a damping part which is attached to the holding part. Mounting and dismounting the butt plate is implemented by means of a front surface of the holding part facing the gun stock and by two forwardly projecting and spaced-apart arch-like retention members for snap-lock retention on two oppositely lying side walls of the gun stock.

U.S. Pat. No. 8,387,297B2 discloses a quick connect/disconnect recoil pad for the butt-end of a shoulder-mounted firearm. The recoil pad can be installed and removed without tools or implements, to swap in another recoil pad.

WO2017/109268A1 discloses a rifle comprising a stock and a grip arranged interchangeable by the user. The grip is attached to the stock of the rifle releasably by fastening means and by a form-fitting attachment arrangement.

The above cited firearms require a large number of production steps to manufacture the stock and the receiver.

EP0903556A1 discloses a portable weapon with a monolithic receiver and stock, made of plastic and provided with a metal insert in order to strengthen the structure.

EP0903556A1 brilliantly solved the problems of known prior art, but over time, the need to improve on some essential features became apparent.

The aim of the present invention is to provide a portable weapon assembly that overcomes the drawbacks of the aforementioned known technique.

Within this aim, an object of the invention is to provide a further improved portable weapon, in particular a long gun such as a shotgun.

A further object of the invention is to provide a portable weapon assembly with improved functionality.

A further object of the invention is to provide a portable weapon assembly with increased longevity.

A further object of the invention is to provide a portable weapon assembly that has a low weight.

A further object of the invention is to provide a portable weapon assembly that can be produced with reduced costs.

A further object of the invention is to provide a portable weapon assembly with superior modularity characteristics.

A further object of the invention is to provide a portable weapon assembly that can be more easily produced.

A further object of the invention is to provide a portable weapon assembly that has superior impact resistance.

A further object of the invention is to provide a portable weapon assembly that offers a superior aesthetic quality.

A further object of the invention is to provide a portable weapon assembly that has greater resistance to corrosion.

A further object of the present invention is to provide an assembly that, due to its special construction characteristics, is capable of ensuring the greatest guarantees of reliability and safety in use.

These aim and objects and others which will better appear hereafter, are achieved by a portable weapon assembly as claimed in the appended claims.

Further characteristics and advantages will become clearer from the description of preferred, but not exclusive, embodiments of the invention, illustrated by way of indicative and non-limiting purposes in the attached drawings, wherein.

Figure 2:
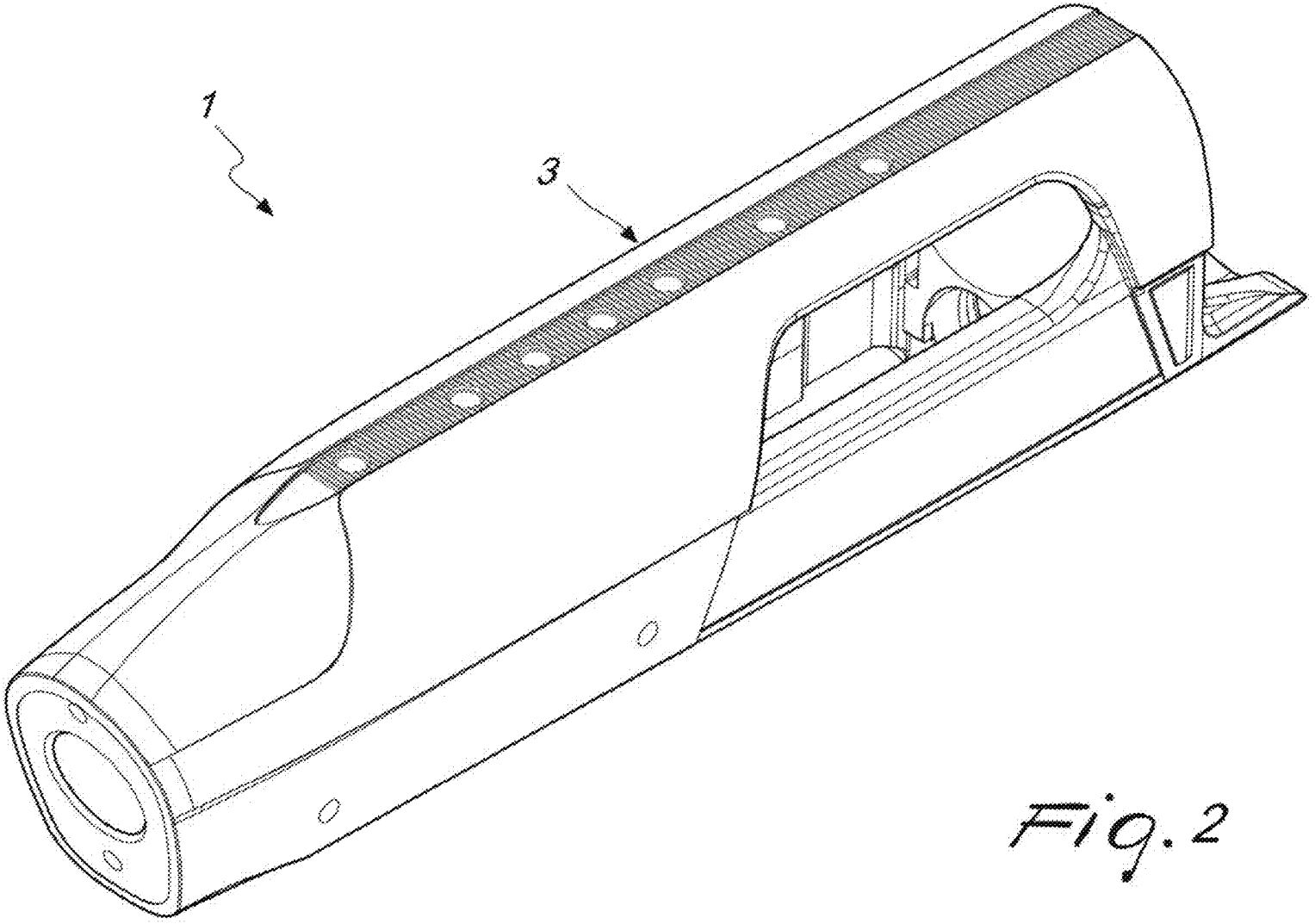
FIG. 2 is a perspective view of the portable weapon assembly according to the invention, in a short version.
Figure 3:
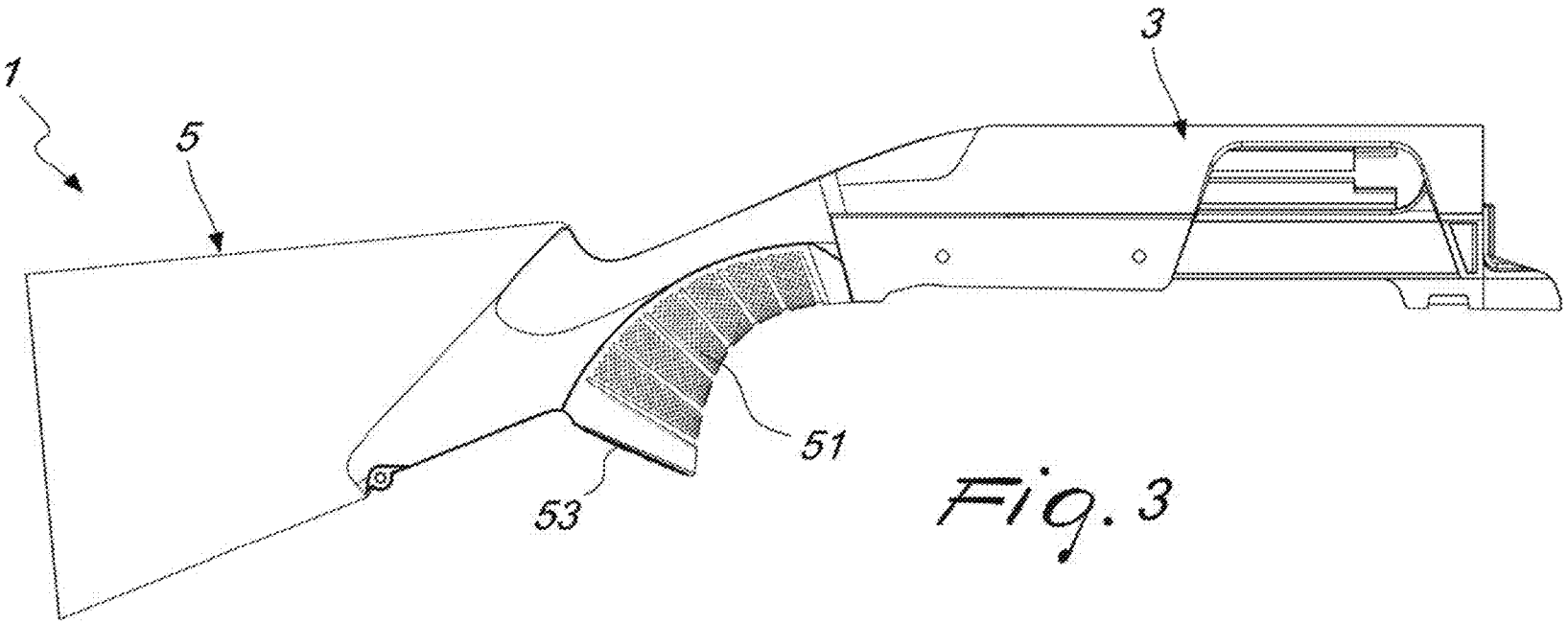
FIG. 3 is a side view of the long version of the assembly.
Figure 4:
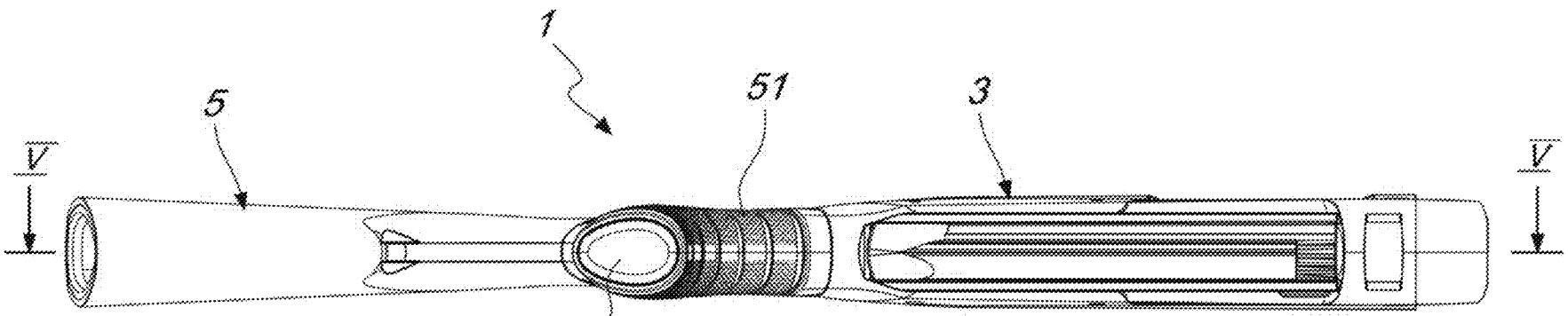
FIG. 4 is a bottom view of the long version of the assembly.
Figure 5:
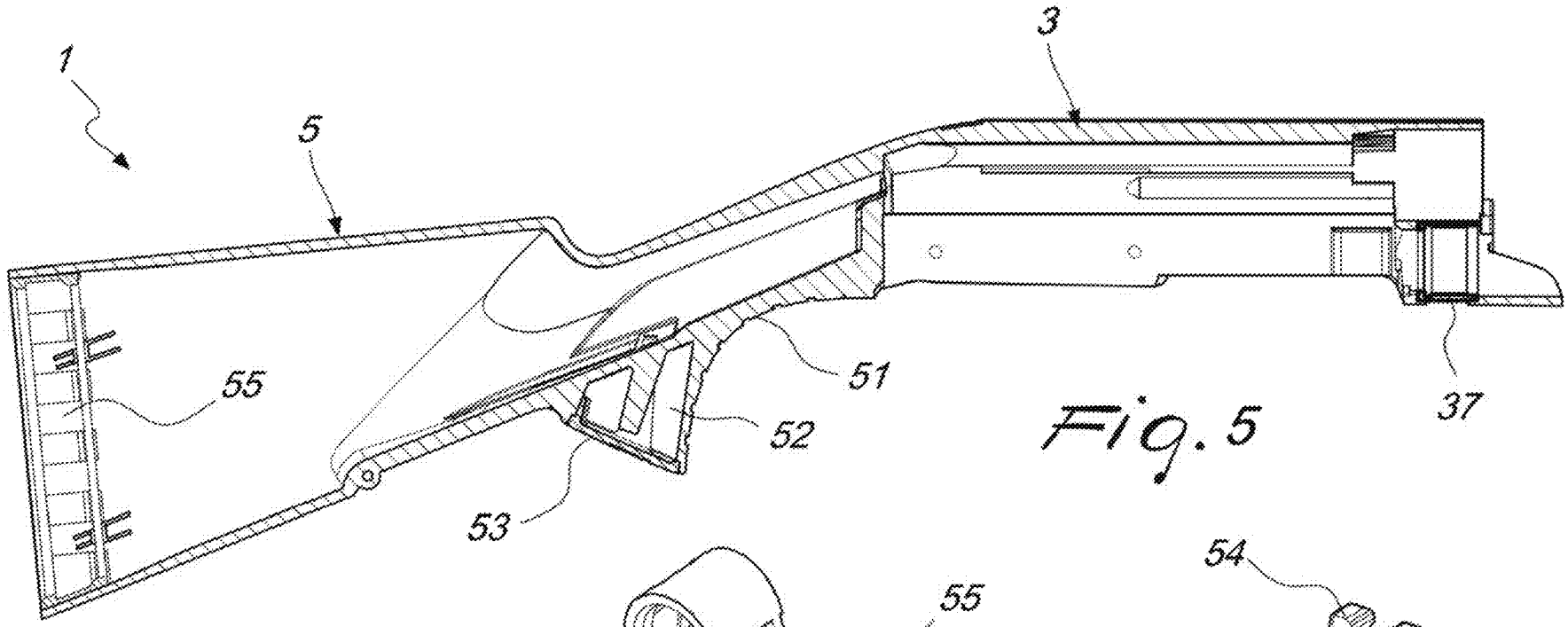
FIG. 5 is a side view, sectioned according to the V-V section plane of FIG. 4.
Figure 7:
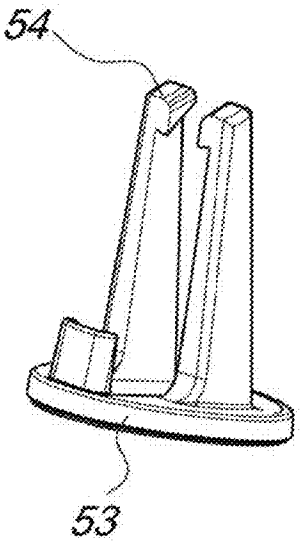
FIG. 7 is a perspective view of the plug of the stock.
Figure 6:
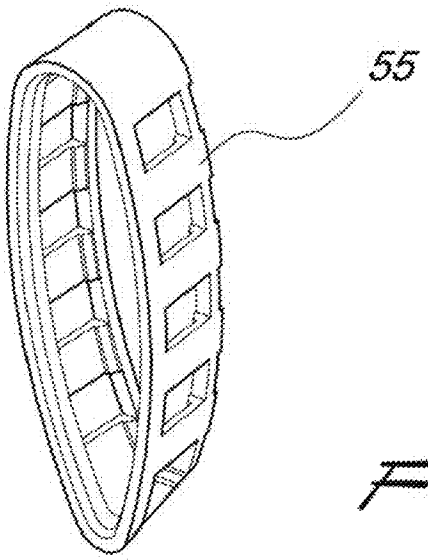
FIG. 6 is a perspective view of the recoil pad attachment ring.
Figure 8:
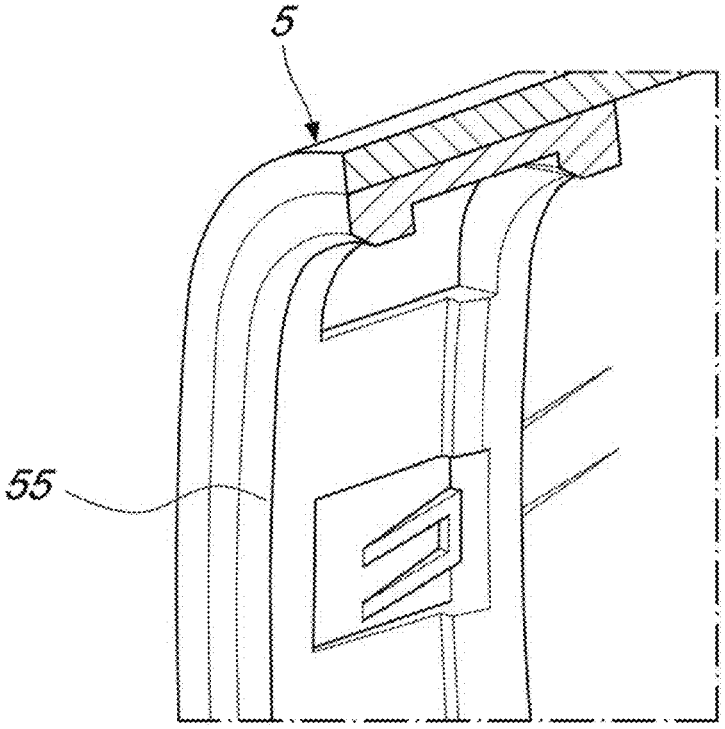
FIG. 8 is an enlarged perspective view illustrating a detail of the cage.
Figure 9:
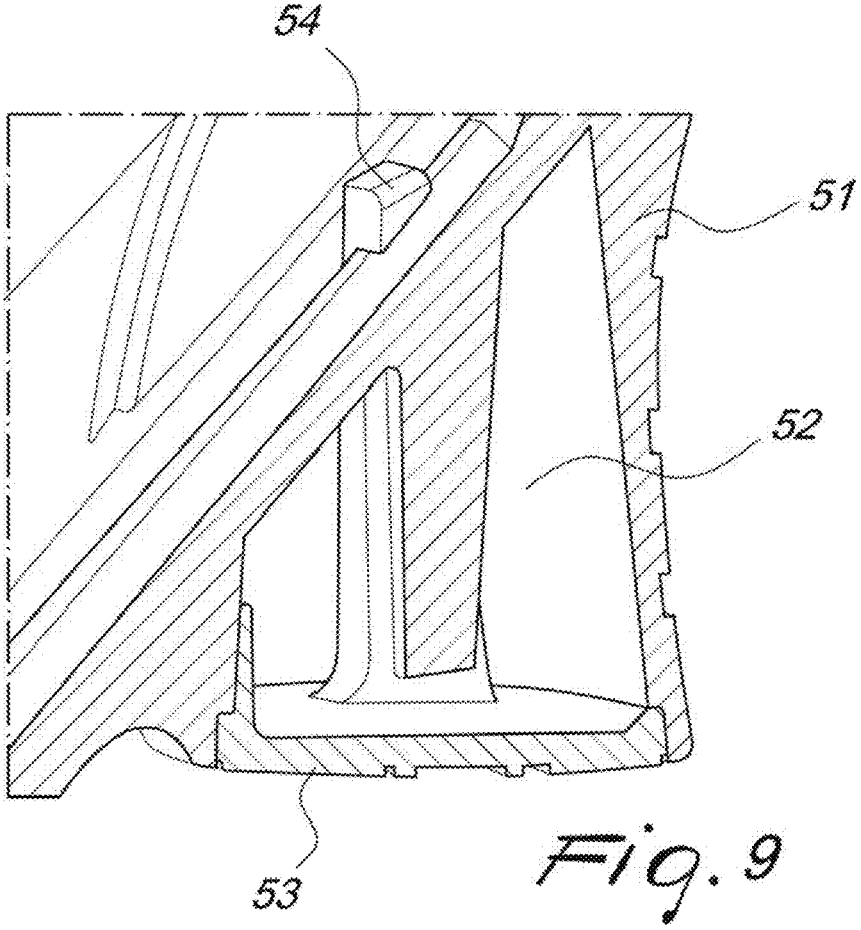
FIG. 9 is an enlarged perspective view illustrating a detail of the plug.

With reference to the figures, the portable weapon assembly according to the invention, globally designated by the reference number 1, is advantageously implemented in a shotgun comprising a receiver portion 3, in a short configuration of the assembly, illustrated for example in FIG. 2.

Figure 1:
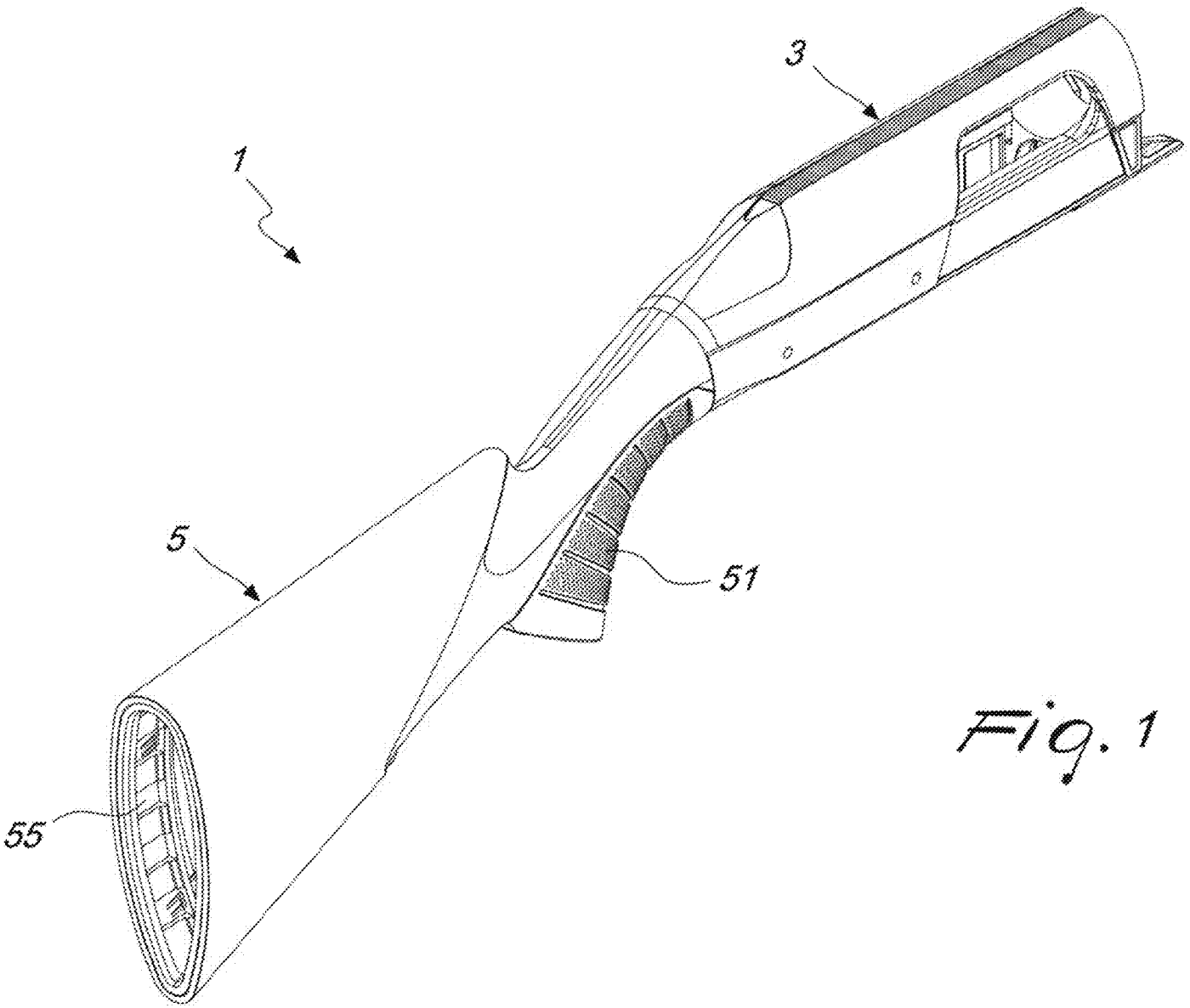
FIG. 1 is a perspective view of the portable weapon assembly according to the invention, in a long version.

According to a further implementation, in a long configuration, as shown in FIG. 1, the portable weapon assembly according to the invention comprises a receiver portion 3 and a stock portion 5.

According to the present invention, the assembly 1 is formed as a single polymer body, without any internal metallic structural element and equipped with an internal cavity that allows for the use of sliding core molds during the molding phase of the assembly.

The internal cavity of the frame offers the advantage of various grip configurations in order to improve the ergonomics of the weapon.

The modular nature of the assembly is configured to minimize the number of variations in the mold and allows the stock to be produced in various shapes.

In a long version, exemplified in FIGS. 1 and 3-7, the assembly has a grip 51 provided with a bottom 52.

The grip 51 is hollow and allows the movement of the mold sliding core.

The bottom 52 is closable by a plug 53 equipped with hook elements 54 that allow the plug 53 to be snapped into the grip.

Advantageously, the stock 5 has a recoil pad attachment system, not illustrated in the figures. The fastening system comprises a cage 55, also made of polymer, which is interlocked internally with the blade of the stock 5.

Figure 10:
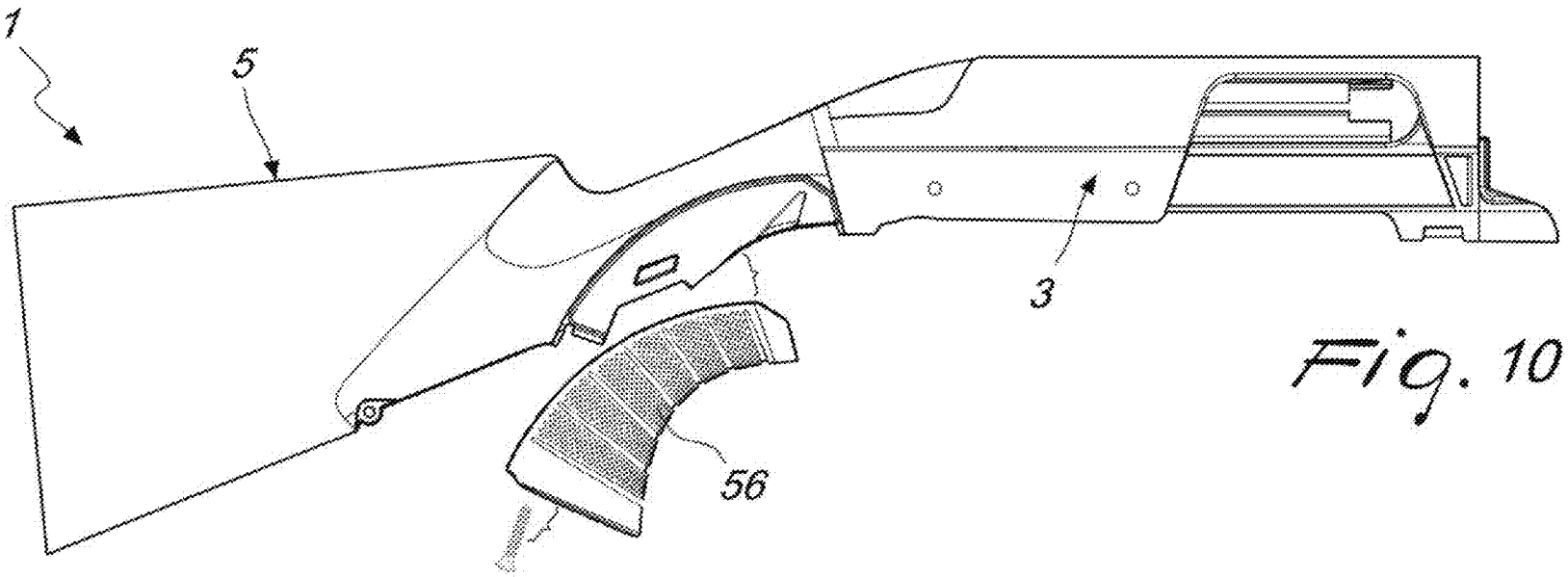
FIG. 10 is a side illustrating mounting the grip to the receiver.
Figure 11:
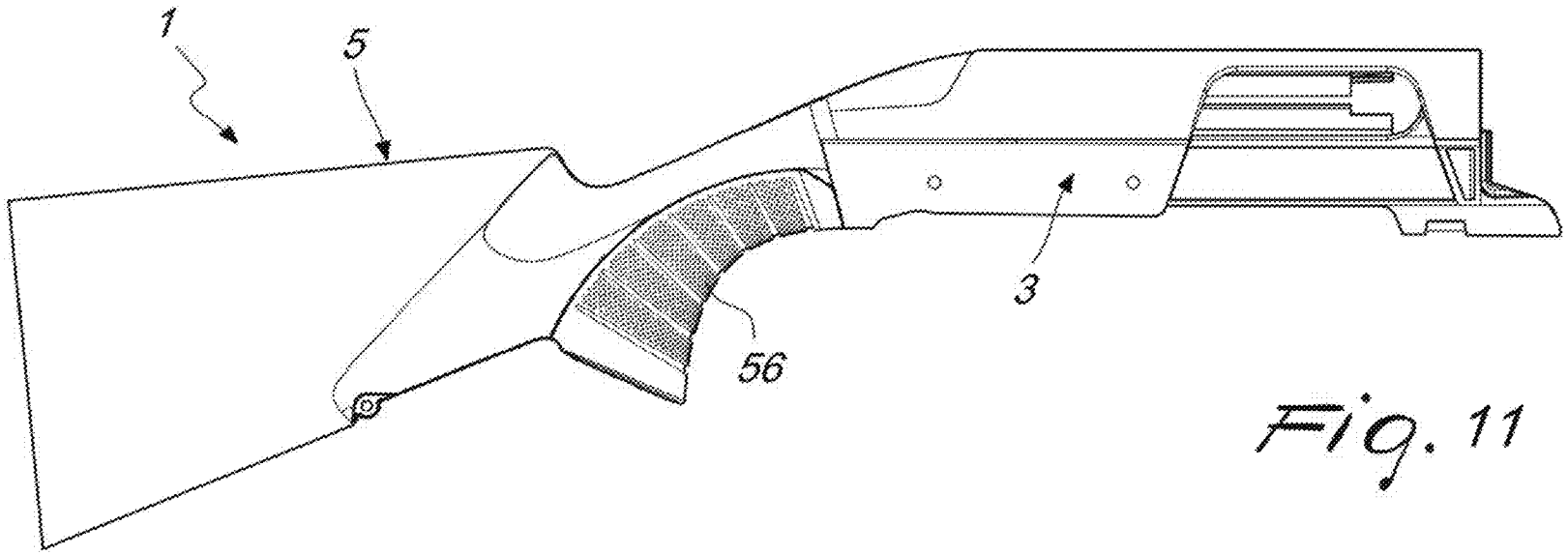
FIG. 11 is a side view illustrating the grip mounted to the receiver.

According to a further aspect of the invention, the long version of the assembly, as shown for example in FIGS. 10-11, has an interchangeable grip 56.

The interchangeable grip 56 allows for various grip configurations, improving the ergonomics of the weapon.

FIGS. 12-15 show an embodiment wherein the receiver 3 has a coupling system for the installation of scope/aiming systems.

Figure 12:
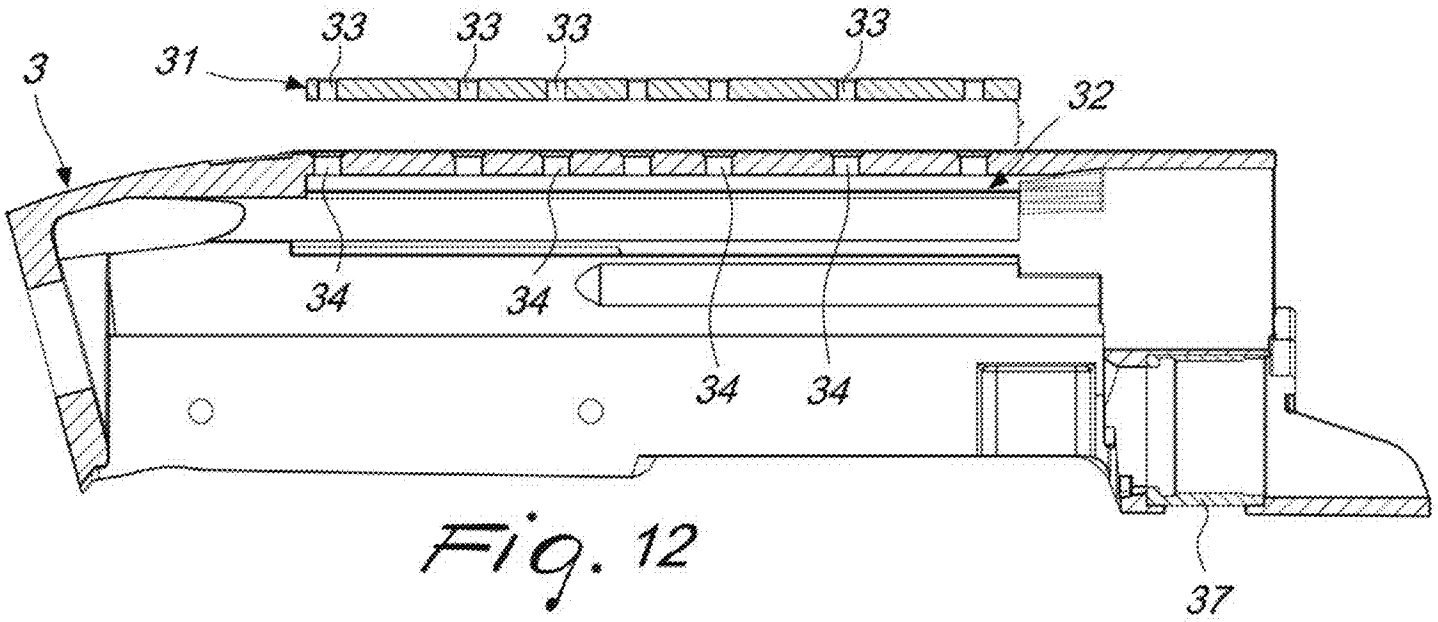
FIG. 12 is a partially sectioned and exploded side view of the receiver, in a rib configuration.
Figure 13:
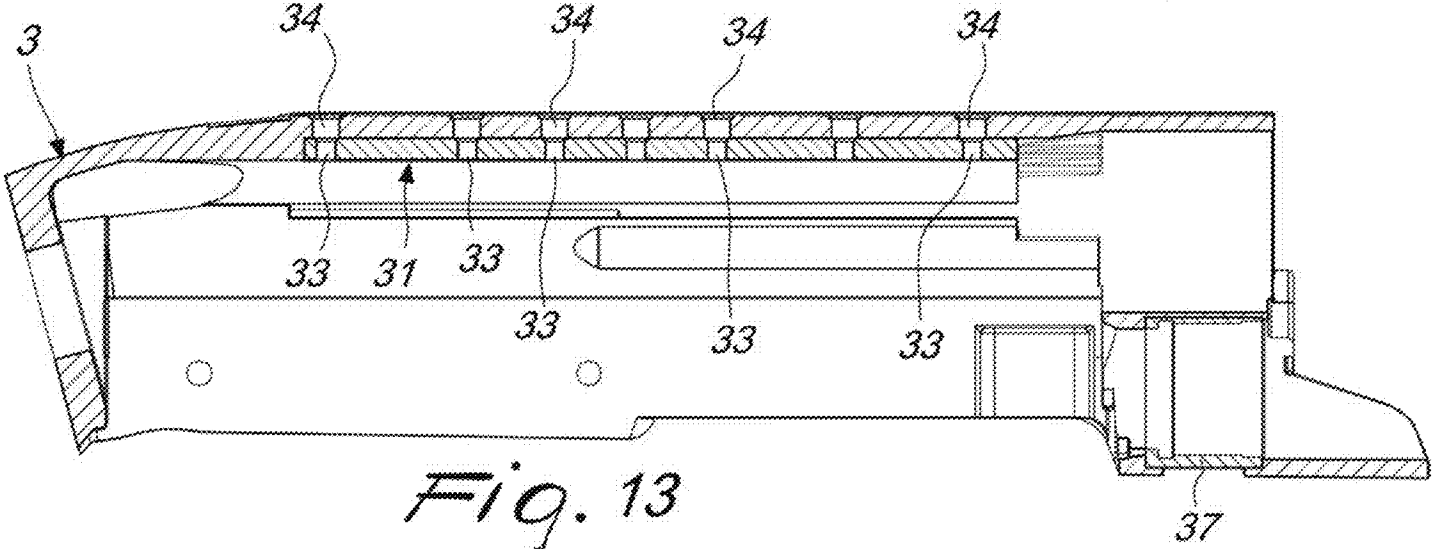
FIG. 13 is a partially sectioned side view of the receiver, in the rib configuration.

According to the embodiment shown in FIGS. 12-13, the assembly has a rib 31 inserted into a longitudinal seat 32 formed in the receiver portion 3.

The rib 31 has threaded holes 33 that correspond to holes 34 in the receiver.

This makes it possible to mount the rib 31 cold.

A slight interference between rib 31 and seat 32, given by exploiting the overhang required for the seat during the molding process, ensures that rib 31 is clamped without causing deformation of the receiver 3.

The presence of the breech, during normal use of the shotgun, ensures that it is impossible for the rib 31 to slip out of its longitudinal seat 32.

The alignment of holes 33 and 34 is ensured by the larger diameter of holes 34 in the receiver compared to holes 33 in the rib 31.

Figure 14:
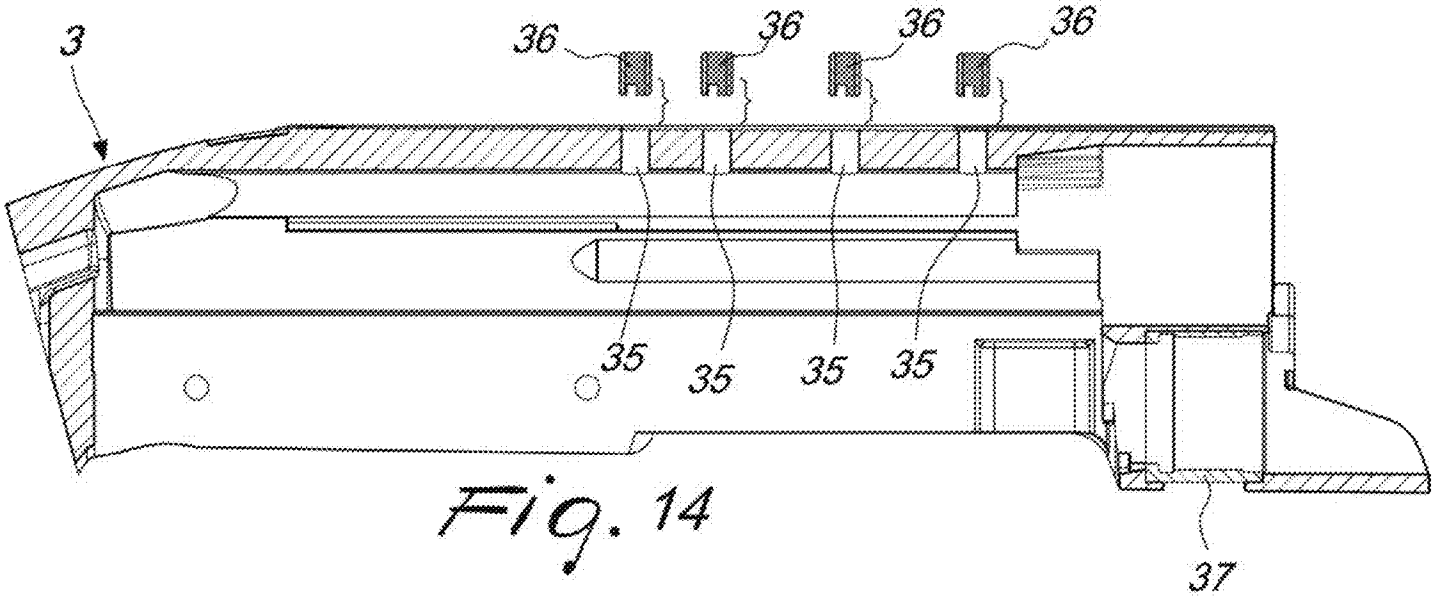
FIG. 14 is a partially sectioned and exploded side view of the receiver, in a configuration with threaded inserts.
Figure 15:
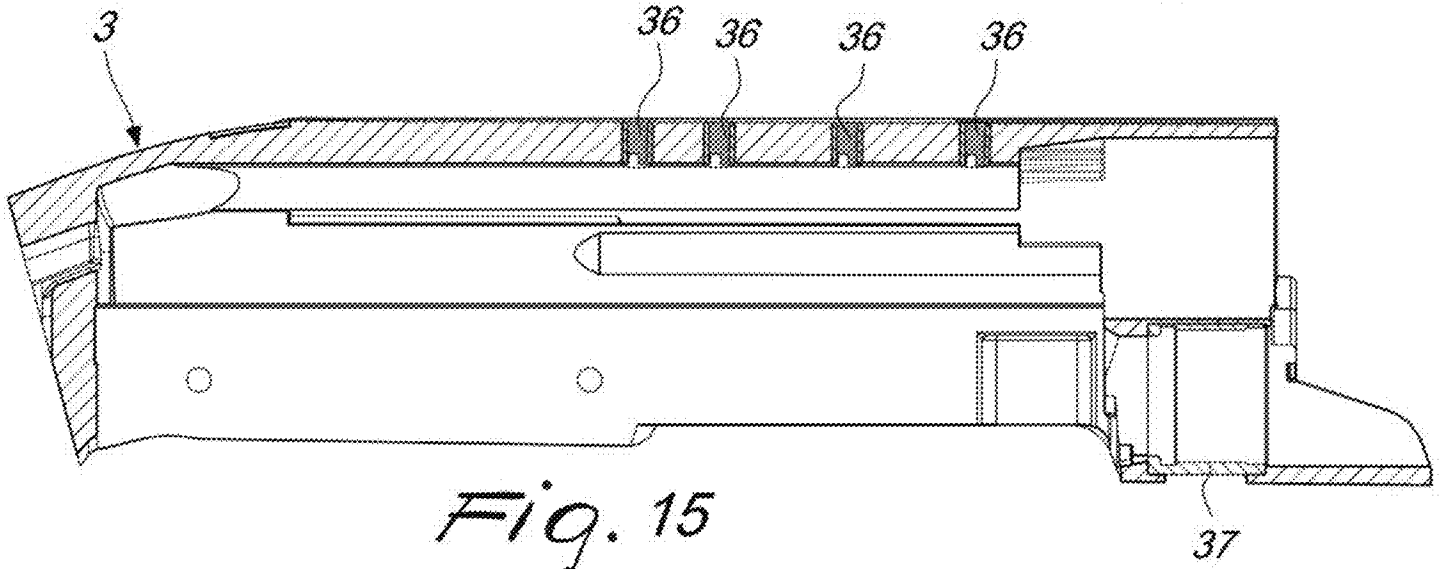
FIG. 15 is a partially sectioned side view of the housing, in the configuration with threaded inserts.
Figure 16:
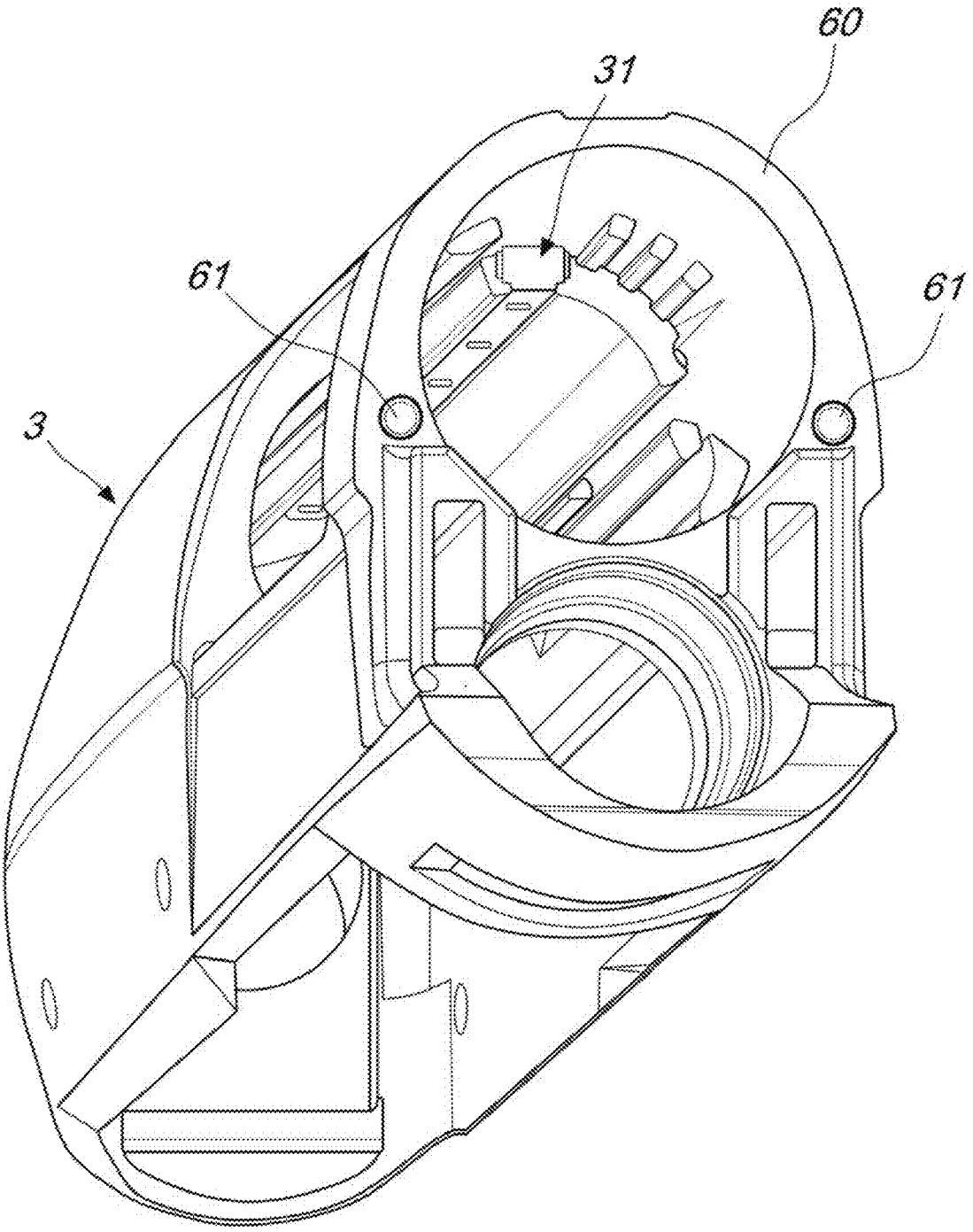
FIG. 16 is a perspective view illustrating the front of the receiver in a configuration with needle rollers and rib.
Figure 17:
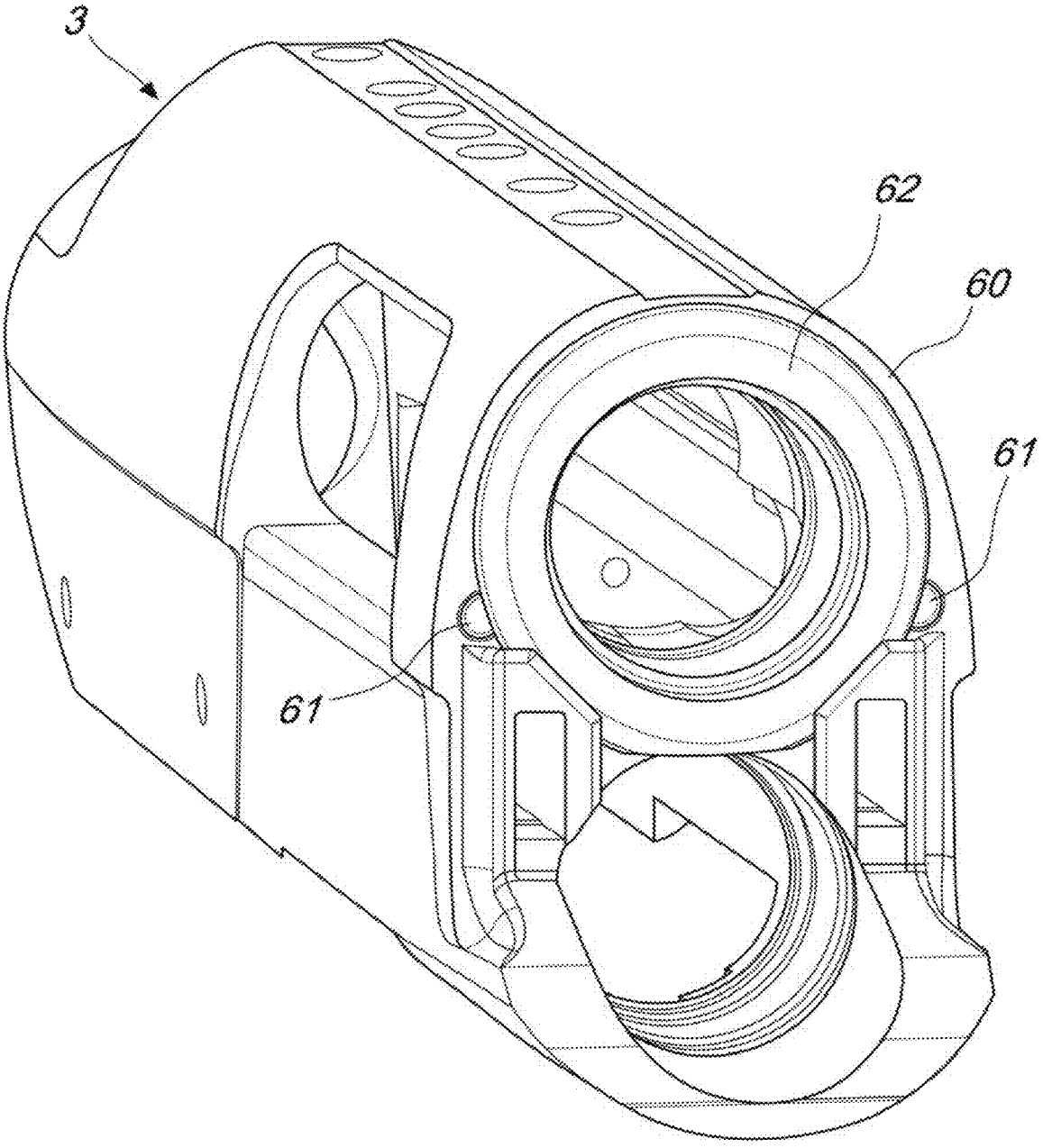
FIG. 17 is a similar view to the previous one in which the mounted breech is visible.
Figure 18:
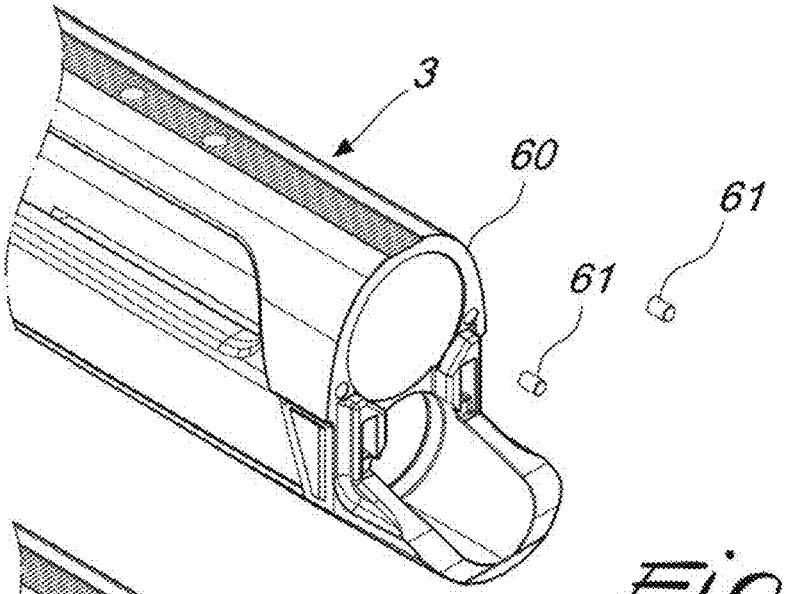
FIG. 18 is a perspective view of the front of the housing, illustrated with the exploded view rollers.
Figure 19:
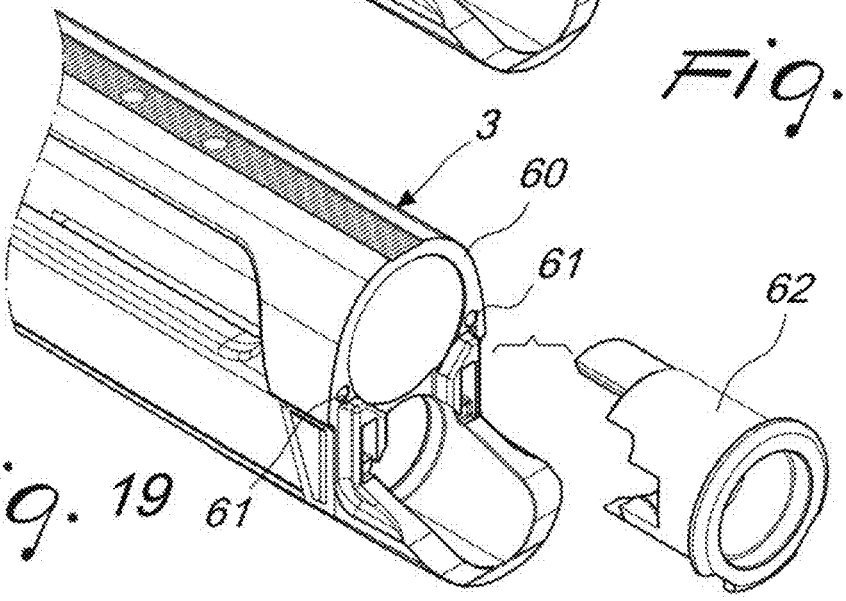
FIG. 19 is a partially exploded perspective view of the front of the receiver, with rollers mounted.
Figure 20:
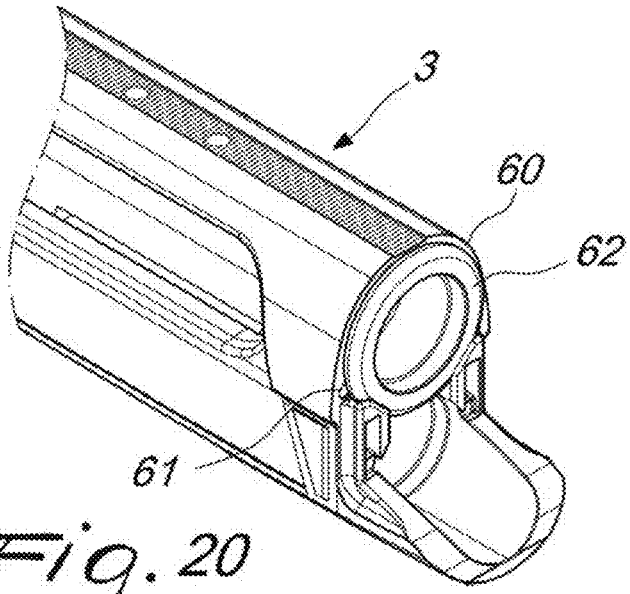
FIG. 20 is a perspective view of the front of the receiver, in the configuration with rollers and breech mounted.
Figure 21:
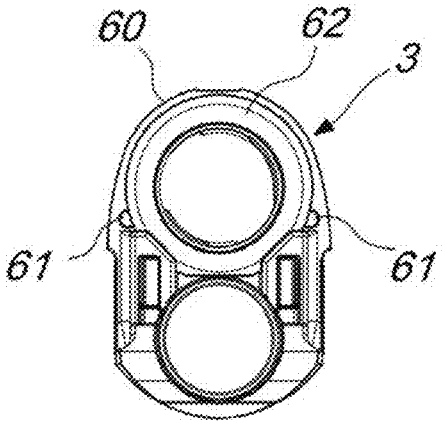
FIG. 21 is a front view of the receiver, in the configuration with needle rollers and breech mounted.
Figure 22:
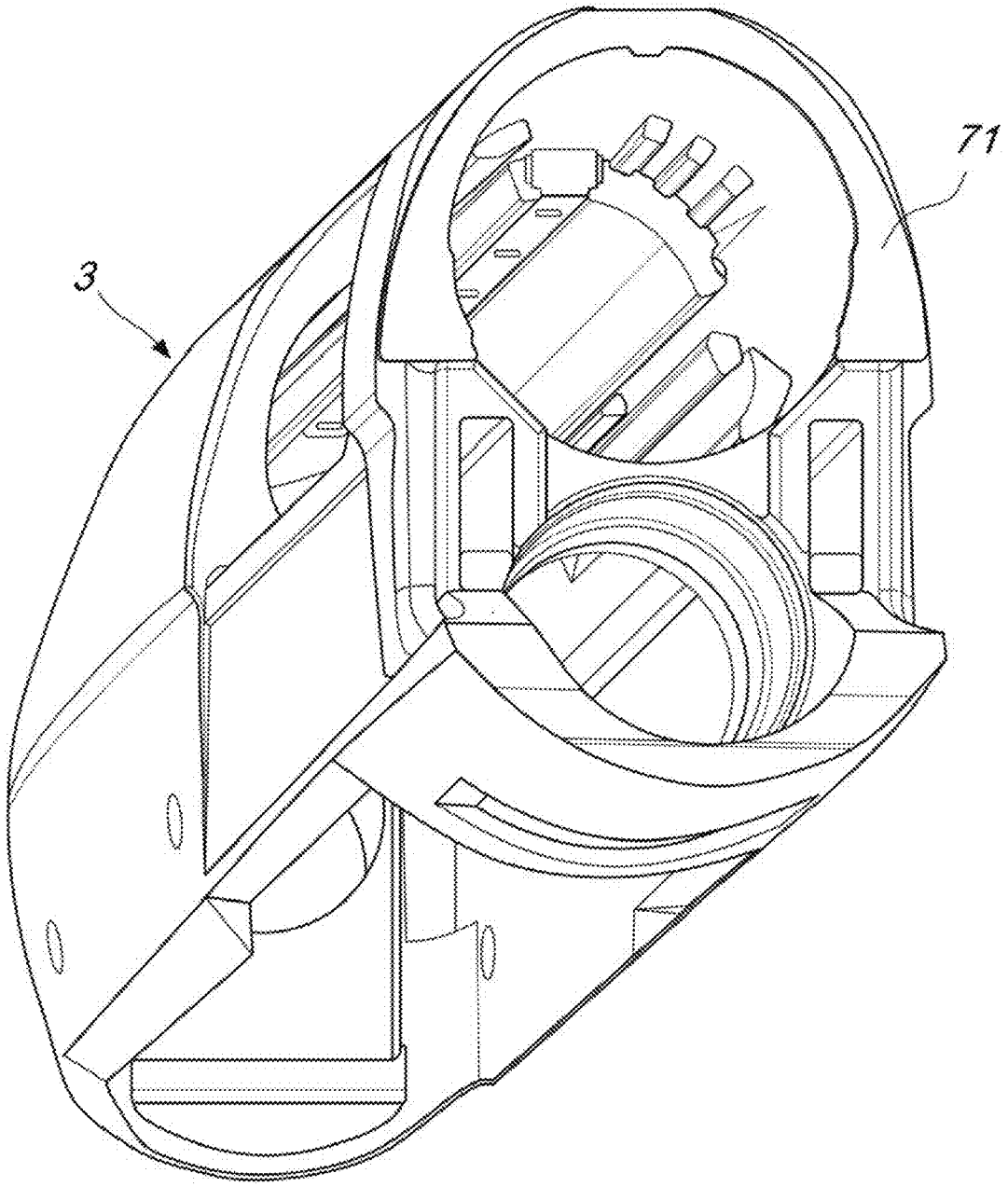
FIG. 22 is a perspective view of the front of the receiver, in the plate configuration.

According to a further embodiment, illustrated in FIGS. 14-15, the upper part of the receiver 3 of the assembly has a series of holes 35 designed to accommodate metallic inserts 36.

The holes 35 are made directly in the polymer structure of the receiver area 3 and the inserts 36 are mounted without further processing.

In order to comply with legal provisions, requiring the weapon's serial number to be affixed to a metal component, advantageously the assembly 1 has a metallic element, in the form of an insert or plate, identified by the reference number 37, on which the prescribed legal indications are affixed.

The assembly according to the present invention also provides devices to better transmit the impulse of the shot onto the polymeric receiver by the breech, through the distribution of this load, and in order to improve impact resistance.

In fact, during the shot, the bottom of the cartridge exerts pressure on the bolt head and this, by means of support planes, discharges it onto the breech.

The polymeric front surface of the receiver is therefore subjected to considerable stresses to the material, given the small surface area of the receiver and breech.

The assembly according to the present invention is suitably and advantageously equipped with additional components designed to more appropriately distribute the pressures during the shot.

The assembly according to the present invention comprises a breech support system comprising metal pins.

The system, illustrated in FIGS. 16-21, comprises metal pins 61, arranged on the face 60 of the receiver 3 and integral with it, which are abutted on the breech 62.

The system illustrated in FIGS. 22-25 shows a molded plate 71 placed between the sides of receiver 3 and breech 72 designed to reduce contact pressure.

Plate 71 is mounted in interference fit on breech 72, which prevents plate 71 from falling off should the barrel assembly be disassembled.

Figure 23:
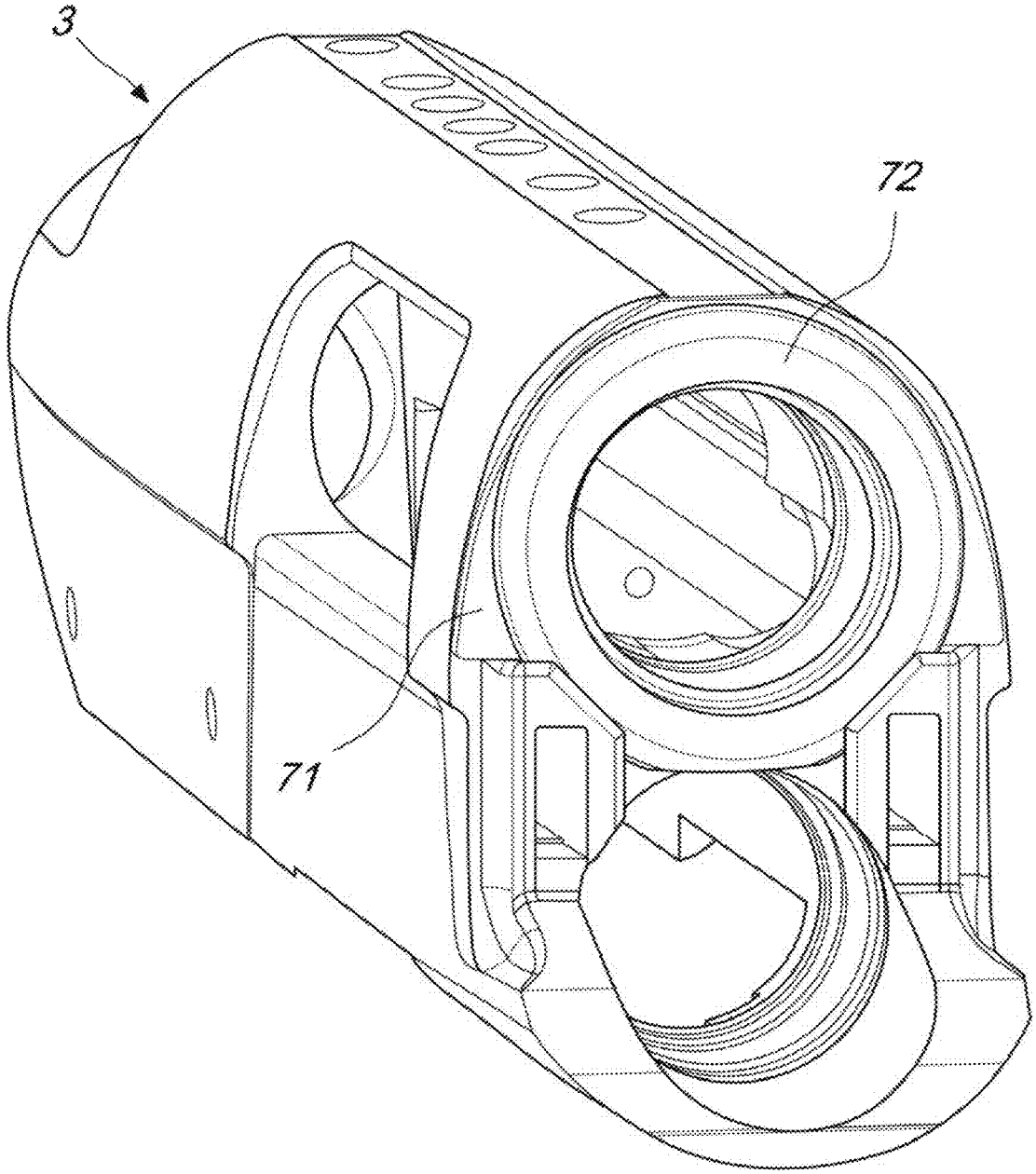
FIG. 23 is a perspective view of the front part of the receiver, in the configuration with plate and breech mounted.
Figure 24:
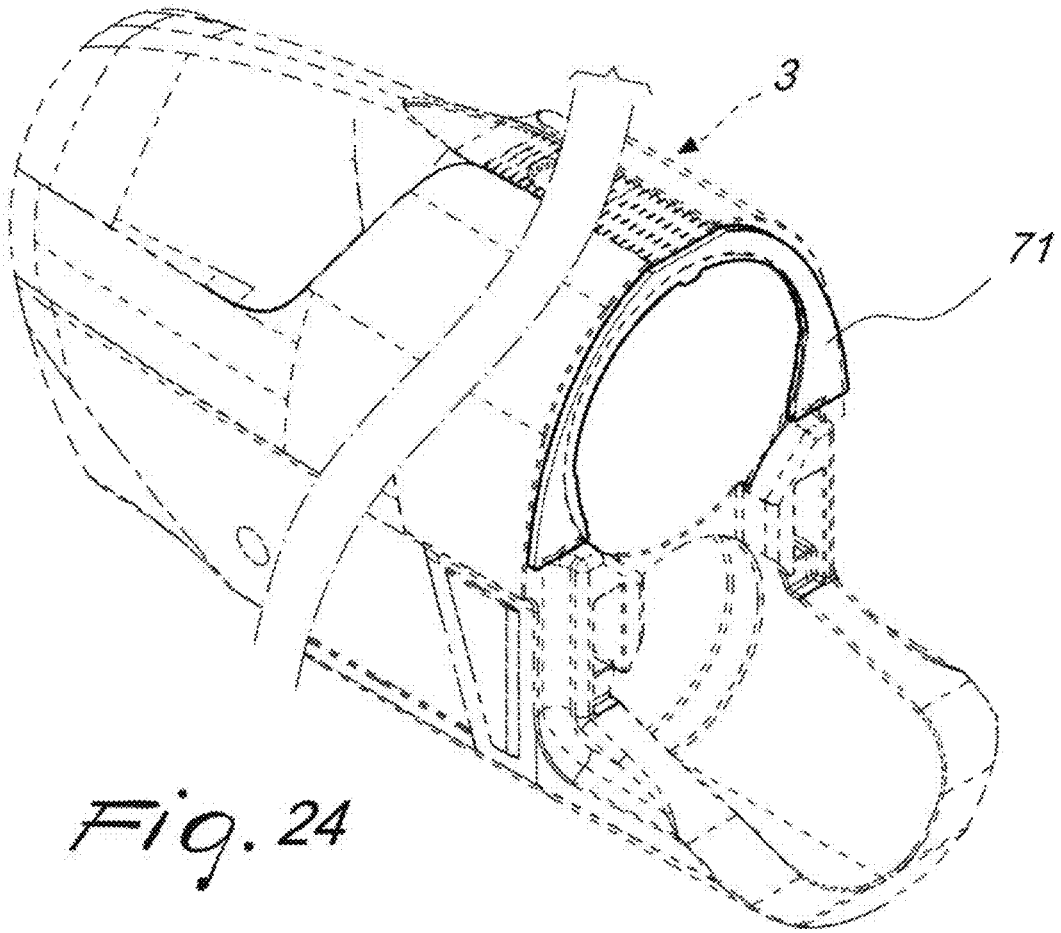
FIG. 24 is a perspective view illustrating the front of the receiver in the plate configuration.
Figure 25:
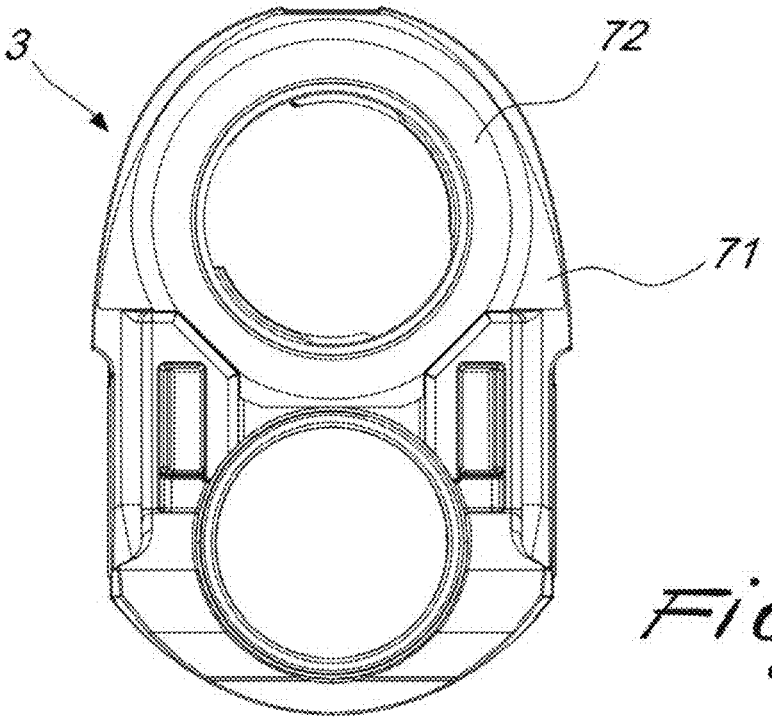
FIG. 25 is a frontal view of the receiver, in the configuration with plate and breech mounted.

FIG. 23 shows how the breech 72 rests on the molded plate 71.

The weapon assembly according to the present invention can advantageously be used for the construction of a modular, all-polymer stock/receiver for firearms such as shotguns.

By way of example, but not limited to, this assembly can be used for both 3" and 3.5" chamberings, and for various gauges.

The elimination of the internal metallic structure brings numerous advantages in terms of functionality and longevity of the weapon.

The internal metallic insert 37 is present for the mere purpose of complying with current legislation that requires the serial number to be written on a metal component integral with the receiver.

An important advantage of the assembly according to the present invention is that it reduces the weight of the component and thus the overall mass of the weapon.

The weight reduction, in turn, not only improves firearm handling, but also reduces the fatigue associated with using the shotgun. The absence of an internal metal frame saves almost 400 g compared to the weight of the weapon of the type described in EP0903556A1.

Removing the metal frame also reduces the overall cost of the assembly as it simplifies the injection molding process.

Also, the cost associated with the raw materials of the steel frame, the manufacturing process and surface treatment of the frame structure (welding and phosphating) and its dimensional inspection/forming is eliminated.

A further advantage is the modularity of the grip in the stock-receiver combination.

The polymer stock-receiver, without an internal metallic structure, gives the freedom to use removable cores, for molding, to have interchangeable grips. This makes it possible to provide a weapon with various grip configurations, improving the ergonomics of the weapon.

Such modularity offers the important advantage of minimizing the number of variants in the mold.

The assembly according to the present invention has the bottom of the grip with a cavity that allows movement of the mold sliding core. This makes it possible to make a hollow handle, with benefits in terms of both weight and the environment, using less raw material.

The system of fastening the recoil pad to the stock, by means of the cage, which is also made of polymer, inserted internally into the stock blade, is particularly advantageous compared to the traditional system in which the grip cavity was covered by a plug fixed with adhesive and the recoil pad attachment ring was instead ultrasonically welded.

In contrast, according to the present invention, both of these components are interlocked on the stock-case, allowing for a streamlined assembly process as well as improved performance.

A further advantage of the present invention is the coupling system for the installation of scope/pointing systems, either by means of inserted strips or threaded inserts.

The threaded insert system allows advantageous mounting of rails and optics accessories.

In fact, in order to install a rail or accessory on a prior art weapon, the metal insert inside the frame had to be drilled and threaded, which not only eliminated the surface treatment of the component, which could lead to rust, but also increased assembly time as the coolant needed to drill the hole required cleaning.

In contrast, according to the present invention, the lack of such a frame allows the polymer to be drilled and the metallic inserts directly inserted without further processing.

Although the internal metallic structure of traditional shotguns increased the rigidity of the system, it also led to a concentration of stress points in the transition zones between polymer and metal, particularly in the grip area.

In contrast, according to the present invention, the absence of the metal structure gives the component a more uniform rigidity, reducing the probability of breakage during an abrupt fall.

Impact resistance was also further improved through the use of software simulations that optimized the geometry of the component, allowing it to be better integrated with the new polymer composites.

In order to transmit the firing impulse to the polymer receiver from the breech, this load should be distributed.

This is because, during firing, the bottom of the cartridge exerts pressure on the bolt head and this, by means of support planes, discharges it onto the breech.

The polymeric front surface of the receiver is therefore subjected to considerable stresses for the material in question, given the small surface area of the receiver and the breech.

The present invention offers additional components that allow for a more appropriate distribution of pressures during firing: the breech resting on metal pins or the breech resting on a molded plate.

The assembly according to the present invention also provides an advantage in terms of the aesthetic quality of the weapon.

The absence of the internal metal frame made it possible to eliminate all aesthetic defects caused by it.

In particular, all areas where the frame was in view were subject to polymer leakage, which adversely affected both aesthetics and sometimes performance and required manual deburring.

The new receiver assembly according to the invention, without internal frame, eliminates all such problems, ensuring an unprecedented aesthetic quality.

The assembly according to the present invention also provides an advantage in terms of corrosion resistance.

In fact, although the traditional metal-core frames had undergone a surface treatment to reduce the likelihood of rusting in areas where the frame was exposed to air, this treatment, applied to high-wear surfaces, could cause rust to form.

Rust formation would not only degrade the mechanical properties of the material over time, but also increase friction between the components, resulting in a less pleasant shooting experience.

The assembly according to the present invention eliminates this risk by leaving only the front metal insert, the one required by legal requirements to engrave the serial number.

In practice, it was found that the invention achieves its aims and objects.

This application claims the priority of Italian Patent Application No. 102023000017088, filed on Aug. 10, 2023, the subject matter of which is incorporated herein by reference.

The invention claimed is:

1. A portable weapon assembly comprising:

a receiver, said receiver being made in a single polymer body without any inner metallic structural element; said assembly having an inner cavity; and a shaped plate arranged between sides of said receiver and of a breech and configured to reduce the contact pressure, said plate being mounted in interference fit on said breech.

2. The assembly, according to claim 1, comprising a stock made in one piece with said receiver.

3. The assembly, according to claim 2, comprising a hollow grip.

4. The assembly, according to claim 3, wherein said hollow grip is closed by a plug.

5. The assembly according to claim 4, wherein said plug comprises hook members for a snap connection of said plug into said grip.

6. The assembly, according to claim 2, wherein said stock comprises a fastening system of a recoil pad, said fastening system comprising a polymer cage that is snapped-in into said stock.

7. The assembly, according to claim 2, comprising an interchangeable grip.

8. The assembly, according to claim 1, comprising a set of holes formed in a top of said receiver and configured to receive metallic inserts.

9. A portable weapon assembly comprising:

a receiver, said receiver being made in a single polymer body without any inner metallic structural element; said assembly having an inner cavity; and a breech resting system comprising metallic pins, said metallic pins being disposed on the front of said receiver and being fastened to said receiver and being in contact with a breech.

10. The portable weapon assembly of claim 9, comprising a shaped plate arranged between sides of said receiver and of said breech and configured to reduce the contact pressure; said plate being mounted in interference fit on said breech.

11. The portable weapon assembly of claim 9, comprising a stock made in one piece with said receiver.

12. The portable weapon assembly of claim 11, wherein said stock comprises a fastening system of a recoil pad, said fastening system comprising a polymer cage that is snapped-in into said stock.

13. The portable weapon assembly of claim 11, comprising an interchangeable grip.

14. The portable weapon assembly of claim 9, comprising a hollow grip.

15. The portable weapon assembly of claim 14, wherein said hollow grip is closed by a plug.

16. The portable weapon assembly of claim 15, wherein said plug comprises hook members for a snap connection of said plug into said grip.

17. The portable weapon assembly of claim 9, comprising a rib inserted into a longitudinal seat made in said receiver; said rib having threaded holes corresponding to holes formed in said receiver.

18. A portable weapon assembly comprising:

a receiver, said receiver being made in a single polymer body without any inner metallic structural element; said assembly having an inner cavity; and a rib inserted into a longitudinal seat made in said receiver; said rib having threaded holes corresponding to holes formed in said receiver.

19. The portable weapon assembly of claim 18, comprising a stock made in one piece with said receiver.

* * * * *